US009724567B1

(12) United States Patent
Wymer

(10) Patent No.: US 9,724,567 B1
(45) Date of Patent: Aug. 8, 2017

(54) SWIM FOOTWEAR

(71) Applicant: Ronald Wymer, San Bernardino, CA (US)

(72) Inventor: Ronald Wymer, San Bernardino, CA (US)

( * ) Notice: Subject to any disclaimer, the term of this patent is extended or adjusted under 35 U.S.C. 154(b) by 0 days.

(21) Appl. No.: 15/015,202

(22) Filed: Feb. 4, 2016

(51) Int. Cl.

| | |
|---|---|
| ***A63B 31/08*** | (2006.01) |
| ***A63B 31/11*** | (2006.01) |
| ***A43B 13/22*** | (2006.01) |
| ***A43B 13/14*** | (2006.01) |
| ***A43B 13/20*** | (2006.01) |
| ***A43B 7/08*** | (2006.01) |
| ***A43B 5/08*** | (2006.01) |

(52) U.S. Cl.
CPC ..... *A63B 31/11* (2013.01); *A43B 5/08* (2013.01); *A43B 7/085* (2013.01); *A43B 13/141* (2013.01); *A43B 13/203* (2013.01); *A43B 13/22* (2013.01)

(58) Field of Classification Search
CPC ..... A63B 31/11
USPC ..... 441/64
See application file for complete search history.

(56) References Cited

U.S. PATENT DOCUMENTS

| | | | | |
|---|---|---|---|---|
| D263,615 | S | 3/1982 | Beuchat | |
| 4,820,218 | A * | 4/1989 | Van de Pol | A63B 31/11 441/64 |
| 5,421,107 | A * | 6/1995 | Bryan | A43B 3/00 36/112 |
| 5,795,204 | A | 8/1998 | Bruner | |
| 6,080,033 | A | 6/2000 | Fladwood et al. | |
| 8,613,148 | B2 | 12/2013 | Rusnak | |
| 2005/0186865 | A1 | 8/2005 | Harwell | |
| 2009/0238400 | A1 | 9/2009 | Im | |

* cited by examiner

*Primary Examiner* — Stephen Avila

(57) ABSTRACT

Swim footwear having integral flippers and sound generators includes a first shoe comprising a sole that is pliable. A compartment is positioned in an interior space defined by the sole. An orifice, positioned in the sole, is fluidically connected to the compartment. A noisemaker is coupled to the sole within the orifice, such that air passing from the compartment through the noisemaker generates a sound. A shell that is coupled to the sole has an entry proximate to a back end of the sole. The shell and the sole define a cavity that is complimentary to the foot of the user. The entry is configured for insertion of the user's foot. A flipper extends from a front end of the sole. The flipper is in substantial parallelism with the sole. The footwear comprises a second shoe that mirrors the first shoe.

19 Claims, 4 Drawing Sheets

SWIM FOOTWEAR

BACKGROUND OF THE DISCLOSURE

Field of the Disclosure

The disclosure relates to footwear and more particularly pertains to new footwear having integral flippers and sound generators.

SUMMARY OF THE DISCLOSURE

An embodiment of the disclosure meets the needs presented above by generally comprising a first shoe comprising a sole that is pliable. A compartment is positioned in an interior space defined by the sole. An orifice, positioned in the sole, is fluidically connected to the compartment. A noisemaker is coupled to the sole within the orifice, such that air passing from the compartment through the noisemaker generates a sound. A shell that is coupled to the sole has an entry proximate to a back end of the sole. The shell and the sole define a cavity that is complimentary to the foot of the user. The entry is configured for insertion of the user's foot. A flipper extends from a front end of the sole. The flipper is in substantial parallelism with the sole. The footwear comprises a second shoe that mirrors the first shoe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
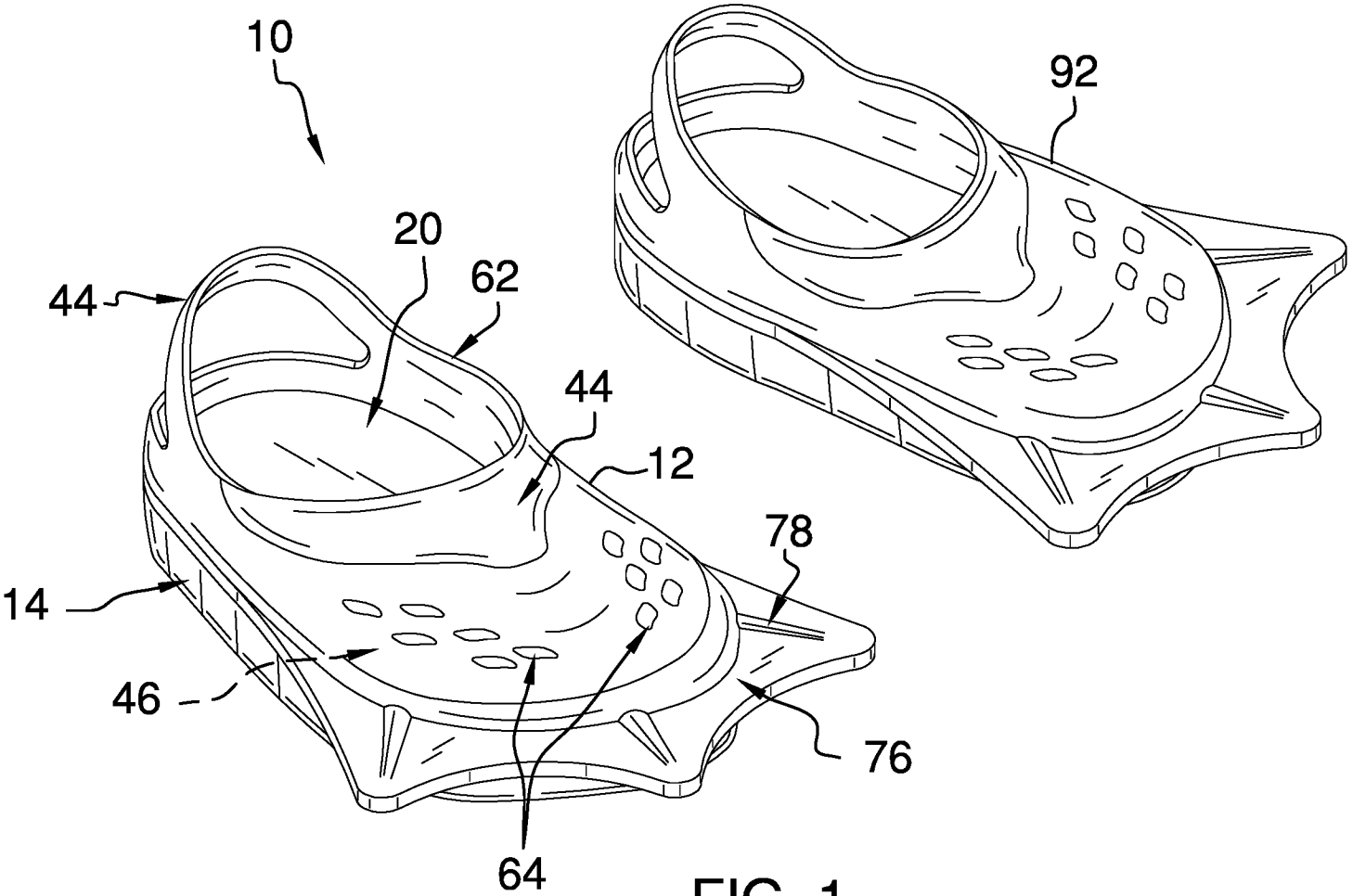
FIG. 1 is an isometric perspective view of swim footwear according to an embodiment of the disclosure.
Figure 2:
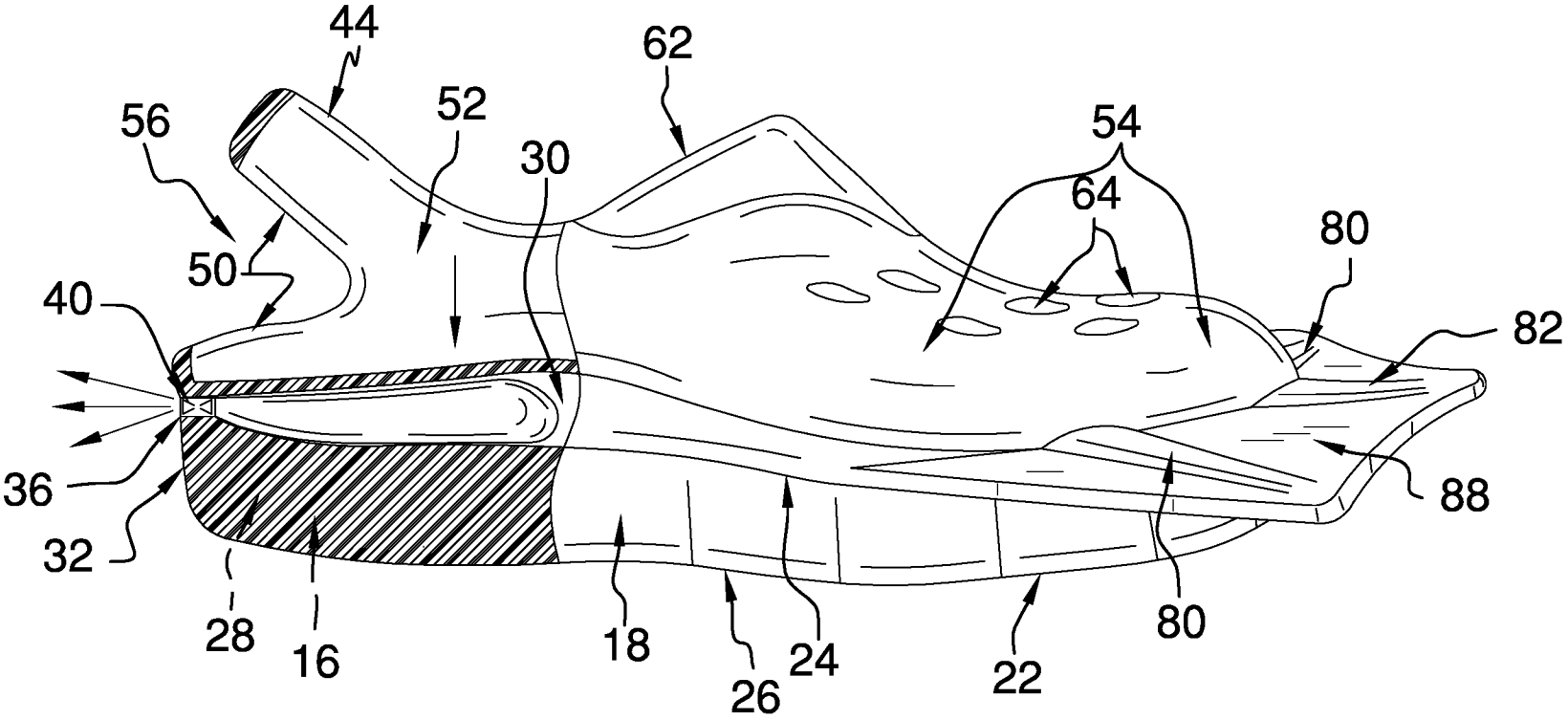
FIG. 2 is a side cross-sectional view of an embodiment of the disclosure.
Figure 3:
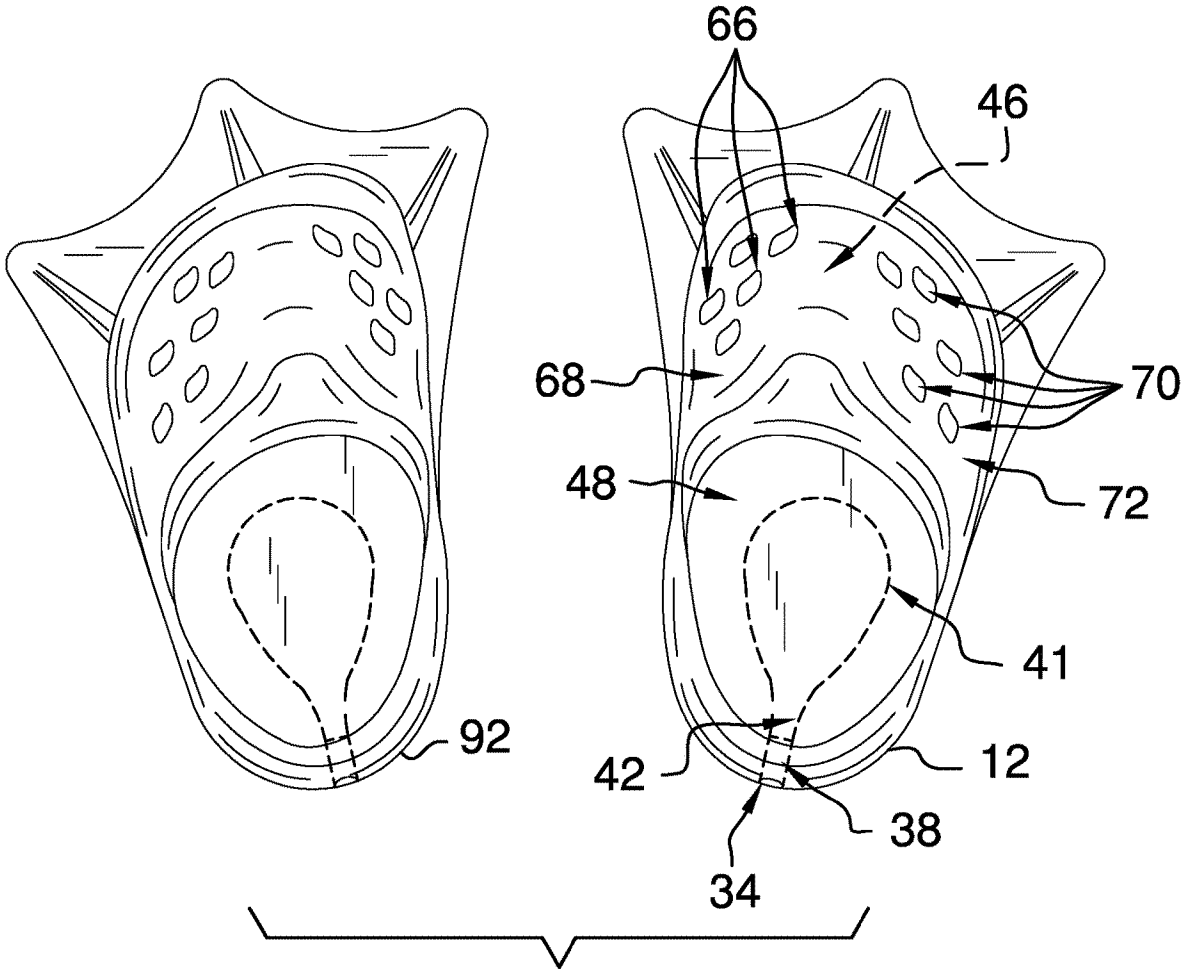
FIG. 3 is a top view of an embodiment of the disclosure.
Figure 4:
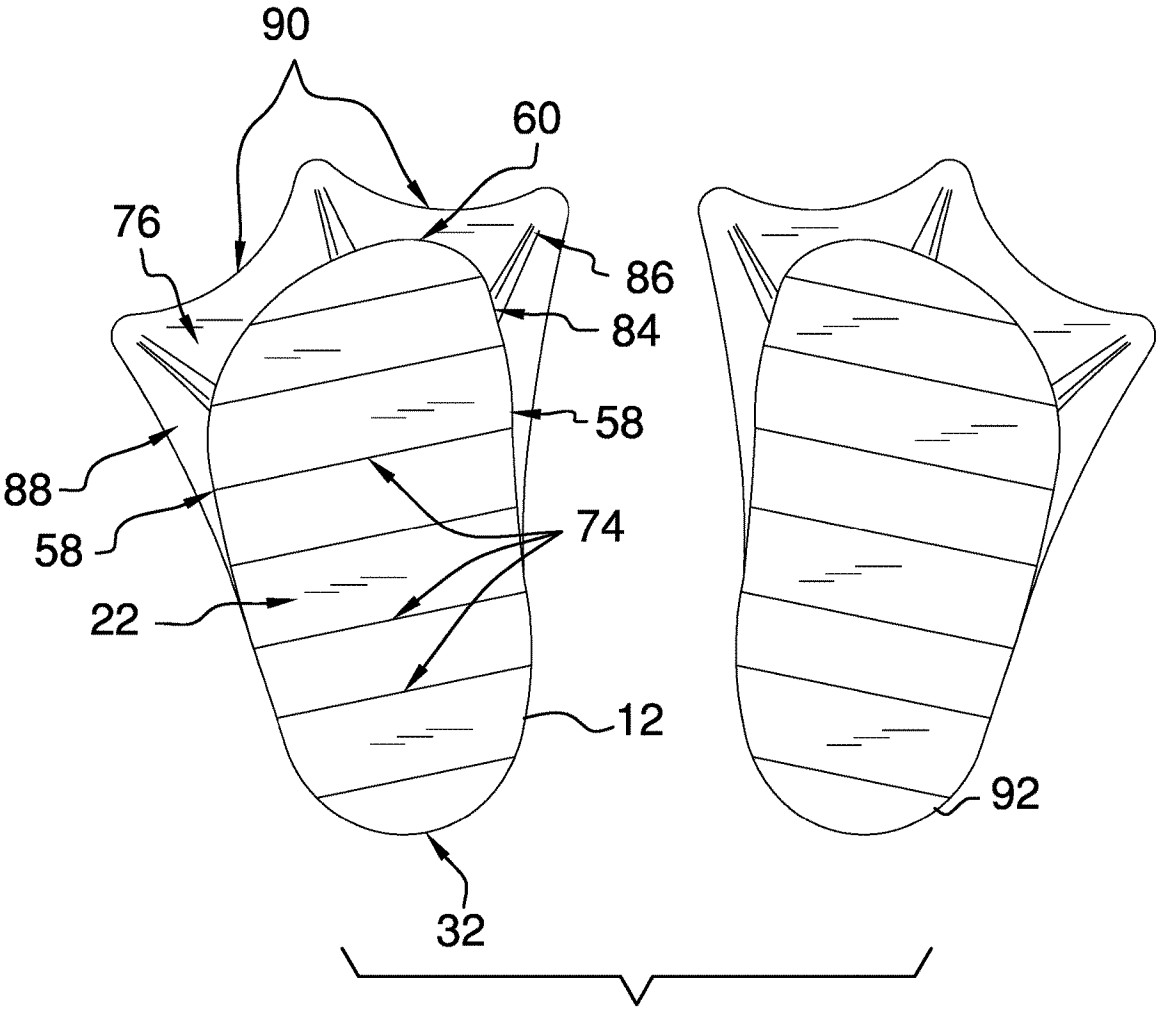
FIG. 4 is a bottom view of an embodiment of the disclosure.

With reference now to the drawings, and in particular to FIGS. 1 through 4 thereof, new footwear embodying the principles and concepts of an embodiment of the disclosure and generally designated by the reference numeral 10 will be described.

As best illustrated in FIGS. 1 through 4, the swim footwear 10 generally comprises a first shoe 12 that comprises a sole 14, which is pliable. The sole 14 defines an interior space 16. The sole 14 comprises an annular sidewall 18, a top layer 20 and a bottom layer 22. The top layer 20 is coupled to an upper edge 24 of the annular sidewall 18 and the bottom layer 22 is coupled to a lower edge 26 of the annular sidewall 18. Preferably, the interior space 16 comprises foam 28.

A compartment 30 is positioned in the interior space 16, preferably proximate to a back end 32 of the sole 14. An orifice 34 is positioned in the sole 14 and is fluidically connected to the compartment 30. The orifice 34 is positioned through the annular sidewall 18 of the sole 14. Preferably, the orifice 34 is positioned at the back end 32 of the sole 14.

A noisemaker 36, which is air powered, is coupled to the sole 14 within the orifice 34. The noisemaker 36 is positioned in the orifice 34 such that air passing from the compartment 30 through the noisemaker 36 generates a sound. The noisemaker 36 may comprise a reed 38, such that the noisemaker 36 is configured to emit a duck call. The noisemaker 36 may comprise a valve 40, such that the noisemaker 36 is configured to emit a frog call. A bladder 41 may be positioned in the compartment 30. The bladder 41 has an open neck 42 that is coupled to the noisemaker 36. The bladder 41 is positioned in the compartment 30 such that compression of the bladder 41 causes air to pass through the noisemaker 36.

A shell 44 is coupled to the sole 14. The shell 44 and the sole 14 define a cavity 46 that is complimentary to the foot of the user. An entry 48 is positioned in the shell 44 proximate to the back end 32 of the sole 14. The entry 48 is configured for insertion of the user's foot. More specifically, the shell 44 comprises a heel cap 50, a pair of quarters 52 and a toe box 54. The heel cap 50 is coupled to and extends upwardly from the back end 32 of the sole 14. A penetration 56 is positioned through the heel cap 50. Preferably, the penetration 56 is rounded. Each quarter 52 is coupled to and extends upwardly from a respective one of opposing sides 58 of the sole 14 proximate to the back end 32. Each quarter 52 also is coupled to the heel cap 50. The toe box 54 is coupled to a front end 60 of the sole 24, to both opposing sides 58 of the sole 14 and to both quarters 52. The toe box 54 and the sole 14 are complementary to the toe end of a user's foot. The heel cap 50, the quarters 52 and the toe box 54 have upper rims 62 that define the entry 48.

A plurality of openings 64 is positioned in the shell 44. The openings 64 are positioned in the shell 44 for water to flow into and drain from the cavity 46. Preferably, the plurality of openings 64 is positioned in the toe box 54 and comprises from three to twenty openings 64. More preferably, the plurality of openings 64 comprises from six to fifteen openings 64. Most preferably, the plurality of openings 64 comprises a group of five openings 66 positioned through a first side 68 of the shell 44 and a group of six openings 70 positioned through a second side 72 of the shell 44. Also preferably, the openings 64 are substantially rectangularly shaped.

A plurality of grips 74 is coupled to the bottom layer 22. The grips 74 are positioned on the sole 14 to prevent slippage of the first shoe 12 when worn by a user.

A flipper 76 extends from the front end 60 of the sole 14 in substantial parallelism with the sole 14. The flipper 76 comprises a plurality of ribs 78 that is substantially rigid. Each rib 78 is coupled to and extends from the front end 60 of the sole 14. The ribs 78 are substantially coplanar. Preferably, the plurality of ribs 78 comprises a pair of outer ribs 80 and a center rib 82, with each outer rib 80 angling away from the center rib 82. The ribs 78 taper from a first end 84 coupled to the sole 14 to a second end 86. A web 88, which is semi-rigid, is coupled to and extends between the ribs 78. The web 88 also is coupled to the sole 14 and extends to proximate to the entry 48. Preferably, the web 88 comprises a pair of convex curves 90. A respective convex curve 90 extends from proximate to the second end 86 of a respective outer rib 80 to proximate to the second end 86 of the center rib 82. The flipper 76 may be configured to resemble a duck's foot. The flipper 76 may be configured to resemble a frog's foot.

The footwear 10 comprises a second shoe 92 that mirrors the first shoe 12.

In use, the entry 48 is positioned in the shell 44 for insertion of a user's foot. The compartment 30 is positioned in the interior space 16 of the sole 14 such that compression of the compartment 30 during walking induces air to flow from the compartment 30 through the noisemaker 36. The flipper 76 is coupled to the sole 14 to aid in swimming.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. Swim footwear comprising:

a first shoe, said first shoe comprising:

a sole, said sole being pliable, said sole defining an interior space, a compartment, said compartment being positioned in said interior space, an orifice, said orifice being positioned in said sole, said orifice being fluidically connected to said compartment, a noisemaker, said noisemaker being air powered, said noisemaker being coupled to said sole within said orifice, wherein said noisemaker is positioned in said orifice such that air passing from said compartment through said noisemaker generates a sound, a shell, said shell being coupled to said sole, said shell and said sole defining a cavity, such that said cavity is complimentary to the foot of the user, and an entry, said entry being positioned in said shell proximate to a back end of said sole, said entry being configured for insertion of the user's foot, a flipper, said flipper extending from a front end of said sole, said flipper being in substantial parallelism with said sole;

a second shoe, said second shoe mirroring said first shoe; and said interior space comprising foam.

2. The footwear of claim 1, further including said sole comprising:

an annular sidewall;

a top layer, said top layer being coupled to an upper edge of said annular sidewall; and a bottom layer, said bottom layer being coupled to a lower edge of said annular sidewall.

3. Swim footwear comprising:

a first shoe, said first shoe comprising:

a sole, said sole being pliable, said sole defining an interior space, a compartment, said compartment being positioned in said interior space, an orifice, said orifice being positioned in said sole, said orifice being fluidically connected to said compartment, a noisemaker, said noisemaker being air powered, said noisemaker being coupled to said sole within said orifice, wherein said noisemaker is positioned in said orifice such that air passing from said compartment through said noisemaker generates a sound, a shell, said shell being coupled to said sole, said shell and said sole defining a cavity, such that said cavity is complimentary to the foot of the user, and an entry, said entry being positioned in said shell proximate to a back end of said sole, said entry being configured for insertion of the user's foot, a flipper, said flipper extending from a front end of said sole, said flipper being in substantial parallelism with said sole;

a second shoe, said second shoe mirroring said first shoe; and said compartment being positioned proximate to said back end of said sole.

4. The footwear of claim 1, further including said orifice being positioned through an annular sidewall of said sole.

5. The footwear of claim 1, further including said orifice being positioned at said back end of said sole.

6. The footwear of claim 1, further including said noisemaker comprising a reed, wherein said noisemaker is configured to emit a duck call.

7. The footwear of claim 1, further including said noisemaker comprising a valve, wherein said noisemaker is configured to emit a frog call.

8. The footwear of claim 1, further including a bladder, said bladder being positioned in said compartment, said bladder having an open neck, said open neck being coupled to said noisemaker, wherein said bladder is positioned in said compartment such that compression of said bladder causes air to pass through said noisemaker.

9. The footwear of claim 1, further including said shell comprising:

a heel cap, said heel cap being coupled to and extending upwardly from said back end of said sole;

a penetration, said penetration being positioned through said heel cap, said penetration being rounded;

a pair of quarters, each said quarter being coupled to and extending upwardly from a respective one of opposing sides of said sole proximate to said back end, each said quarter being coupled to said heel cap;

a toe box, said toe box being coupled to a front end of said sole, said toe box being coupled to both opposing sides of said sole and both said pair of quarters, such that said toe box and said sole are complementary to the toe end of a user's foot;

said heel cap, said quarters and said toe box having upper rims, said upper rims defining said entry; and a plurality of openings, said plurality of openings being positioned in said shell, such that said openings are positioned in said shell for water to flow into and drain from said cavity.

10. The footwear of claim 9, further including said plurality of openings being positioned in said toe box, said plurality of openings comprising from three to twenty openings.

11. The footwear of claim 10, further including said plurality of openings comprising from six to fifteen openings.

12. The footwear of claim 11, further including said plurality of openings comprising a group of five openings positioned through a first side of said shell and a group of six openings positioned through a second side of said shell.

13. The footwear of claim 9, further including said openings being substantially rectangularly shaped.

14. The footwear of claim 2, further including a plurality of grips, said grips being coupled to said bottom layer, such that said grips are positioned on said sole to prevent slippage of said first shoe when worn by a user.

15. The footwear of claim 1, further including said flipper comprising:

a plurality of ribs, said ribs being substantially rigid, each said rib being coupled to and extending from said front end of said sole, said ribs being substantially coplanar; and a web, said web being semi-rigid, said web being coupled to and extending between said ribs, said web being coupled to said sole, said web extending to proximate to said entry.

16. The footwear of claim 15, further comprising:

said plurality of ribs comprising a pair of outer ribs and a center rib, each said outer rib angling away from said center rib, said ribs tapering from a first end coupled to said sole to a second end; and said web comprising a pair of convex curves, a respective said convex curve extending from proximate to a second end of a respective said outer rib to proximate to a second end of said center rib.

17. The footwear of claim 1, further including said flipper being configured to resemble a duck's foot.

18. The footwear of claim 1, further including said flipper being configured to resemble a frog's foot.

19. Swim footwear comprising:

a first shoe, said first shoe comprising:

a sole, said sole being pliable, said sole defining an interior space, said sole comprising:

an annular sidewall, a top layer, said top layer being coupled to an upper edge of said annular sidewall, and a bottom layer, said bottom layer being coupled to a lower edge of said annular sidewall, said interior space comprising foam, a compartment, said compartment being positioned in said interior space, said compartment being positioned proximate to a back end of said sole, an orifice, said orifice being positioned in said sole, said orifice being fluidically connected to said compartment, said orifice being positioned through said annular sidewall of said sole, said orifice being positioned at said back end of said sole, a noisemaker, said noisemaker being air powered, said noisemaker being coupled to said sole within said orifice, wherein said noisemaker is positioned in said orifice such that air passing from said compartment through said noisemaker generates a sound, said noisemaker comprising a reed, said noisemaker comprising a valve, wherein said noisemaker is configured to emit a duck call, wherein said noisemaker is configured to emit a frog call, a bladder, said bladder being positioned in said compartment, said bladder having an open neck, said open neck being coupled to said noisemaker, wherein said bladder is positioned in said compartment such that compression of said bladder causes air to pass through said noisemaker, a shell, said shell being coupled to said sole, said shell and said sole defining a cavity, such that said cavity is complimentary to the foot of the user, an entry, said entry being positioned in said shell proximate to a back end of said sole, said entry being configured for insertion of the user's foot, said shell comprising:

a heel cap, said heel cap being coupled to and extending upwardly from said back end of said sole, a penetration, said penetration being positioned through said heel cap, said penetration being rounded, a pair of quarters, each said quarter being coupled to and extending upwardly from a respective one of opposing sides of said sole proximate to said back end, each said quarter being coupled to said heel cap, a toe box, said toe box being coupled to a front end of said sole, said toe box being coupled to both opposing sides of said sole and both said pair of quarters, such that said toe box and said sole are complementary to the toe end of a user's foot, and said heel cap, said quarters and said toe box having upper rims, said upper rims defining said entry, and a plurality of openings, said plurality of openings being positioned in said shell, such that said openings are positioned in said shell for water to flow into and drain from said cavity, and said plurality of openings being positioned in said toe box, said plurality of openings comprising from three to twenty openings, said plurality of openings comprising from six to fifteen openings, said plurality of openings comprising a group of five openings positioned through a first side of said shell and a group of six openings positioned through a second side of said shell, said openings being substantially rectangularly shaped, a plurality of grips, said grips being coupled to said bottom layer, such that said grips are positioned on said sole to prevent slippage of said first shoe when worn by a user;

a flipper, said flipper extending from a front end of said sole, said flipper being in substantial parallelism with said sole, said flipper comprising:

a plurality of ribs, said ribs being substantially rigid, each said rib being coupled to and extending from said front end of said sole, said ribs being substantially coplanar, said plurality of ribs comprising a pair of outer ribs and a center rib, each said outer rib angling away from said center rib, said ribs tapering from a first end coupled to said sole to a second end, and a web, said web being semi-rigid, said web being coupled to and extending between said ribs, said web being coupled to said sole, said web extending to proximate to said entry, said web comprising a pair of convex curves, a respective said convex curve extending from proximate to a second end of a respective said outer rib to proximate to a second end of said center rib, and said flipper being configured to resemble a duck's foot, said flipper being configured to resemble a frog's foot; and a second shoe, said second shoe mirroring said first shoe.

* * * * *